US005434354A

United States Patent [19]

Baker et al.

[11] Patent Number: 5,434,354

[45] Date of Patent: Jul. 18, 1995

[54] INDEPENDENT TWIN-FOIL SHIELDED DATA CABLE

[75] Inventors: James Baker, Princeton, Mass.; Barry Gelfand, Goffstown, N.H.

[73] Assignee: Mohawk Wire and Cable Corp., Leominster, Mass.

[21] Appl. No.: 179,505

[22] Filed: Dec. 30, 1993

[51] Int. Cl.[6] ..... H01B 7/34

[52] U.S. Cl. ..... 174/36; 174/106 R; 174/115

[58] Field of Search ..... 174/36, 106 R, 115, 174/105 R

[56] References Cited

U.S. PATENT DOCUMENTS

| | | | |
|---|---|---|---|
| 2,041,842 | 5/1936 | Layton | 174/36 |
| 2,344,501 | 3/1944 | Bennett | 174/106 R |
| 2,447,168 | 8/1948 | Dean et al. | 174/105 R |
| 2,691,698 | 10/1954 | Schmidt . | |
| 4,510,346 | 4/1995 | Bursh, Jr. et al. | 174/36 |
| 5,132,491 | 7/1992 | Mulrooney et al. | 174/36 |
| 5,214,243 | 5/1993 | Johnson | 174/36 |
| 5,216,204 | 6/1993 | Dudek et al. | 174/36 |
| 5,274,712 | 12/1993 | Lindsay et al. | 174/36 |

FOREIGN PATENT DOCUMENTS

| | | | |
|---|---|---|---|
| 216883 | 8/1958 | Australia | 174/106 R |
| 151232 | 10/1937 | Germany | 174/36 |
| 4-264312 | 9/1992 | Japan | 174/36 |
| 8202627 | 1/1984 | Netherlands | 174/36 |

*Primary Examiner*—Morris H. Nimmo
*Attorney, Agent, or Firm*—Wolf, Greenfield & Sacks

[57] ABSTRACT

An independent twin-foil shielded data cable is disclosed. The cable includes a cable core which may have one or more insulated data conductors. The cable core is wrapped by a foil-shield laminate tape color helically wound about the cable core. The laminate tape includes a non-conductive side facing the cable core and a conductive side facing outward from the cable core. A second-foil laminate shield tape is helically wound about the cable, having a conductive side disposed towards the conductive side of the first shield laminate and a non-conductive side disposed to the outside of the cable. Finally, the entire cable assembly may be enclosed in a protective, insulating jacket.

13 Claims, 3 Drawing Sheets

INDEPENDENT TWIN-FOIL SHIELDED DATA CABLE

FIELD OF THE INVENTION

The present invention is related to the field of high-speed electronic data cable. More particularly, the invention is related to high-speed data cable, wherein the data is carried by conductor pairs and the cable includes an overall shield.

BACKGROUND OF THE INVENTION

Conventional shielded high-speed data cables, such as shown in FIGS. 1A and 1B generally include two or more pairs of insulated conductors 101 wrapped by a longitudinally applied laminate 102 of metal foil on a polymer base, thus forming a shield. This structure has a drain wire 109 applied in contact with the metal foil, and is contained within a suitable jacket 106.

The above-described structure has been found to be inadequate for some applications due to excessive leakage, because the metal foil shield frequently develops pin holes or tears during manufacture and installation. Furthermore, the longitudinally applied metal foil shield does not adequately control the dielectric spacing between conductor pairs, or between the pairs and the shield, resulting in erratic performance characteristics of such cable.

Some manufacturers have attempted to solve the above-noted problem by using two longitudinally applied metal foil or polymer laminate 102 and 108 shields or a single laminate 110 helically applied with edges overlapping. However, these attempted solutions often prove to be inadequate, because these attempted solutions do not address the issue of adequately controlling the dielectric spacing between conductor pairs.

SUMMARY OF THE INVENTION

The problems noted above with conventional shielded high-speed data cables have been addressed by the present invention, wherein there is provided an independent twin-foil shielded data cable capable of speeds of up to about 155 Mb/S.

The independent twin-foil shielded data cable according to one aspect of the present invention includes a cable core of at least one insulated conductor; an inner shield helically wrapped about the cable core, having a conductive layer; an outer shield helically wrapped about the cable core, having a conductive layer; and a flexible outer jacket.

In accordance with other aspects of the present invention, there may be provided a drain wire between the shields, the shields may be laminated of conductive and non-conductive material, a binder may be used to bind the cable core, and various materials may be used for the disclosed elements. These and other options are discussed in the Detailed Description, below.

BRIEF DESCRIPTION OF THE DRAWING

Like reference numerals indicate like elements in the figures, in which.

DETAILED DESCRIPTION

Figure 1A:
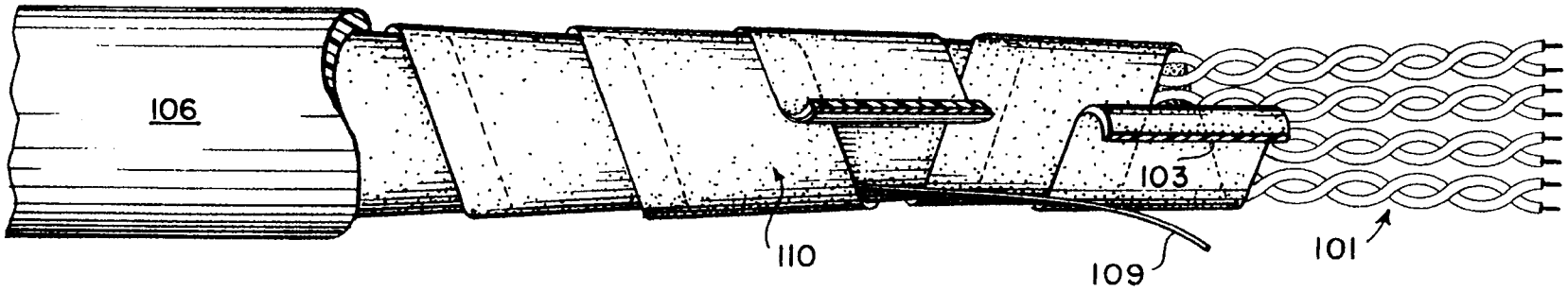
FIGS. 1A and 1B are cut away illustrations of conventional shielded high-speed data cables.
Figure 1B:
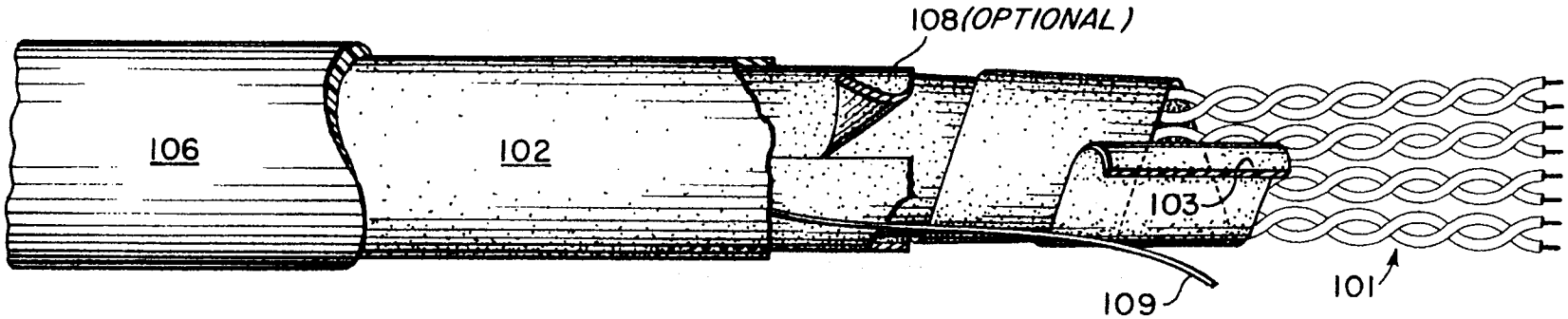
Figure 2:
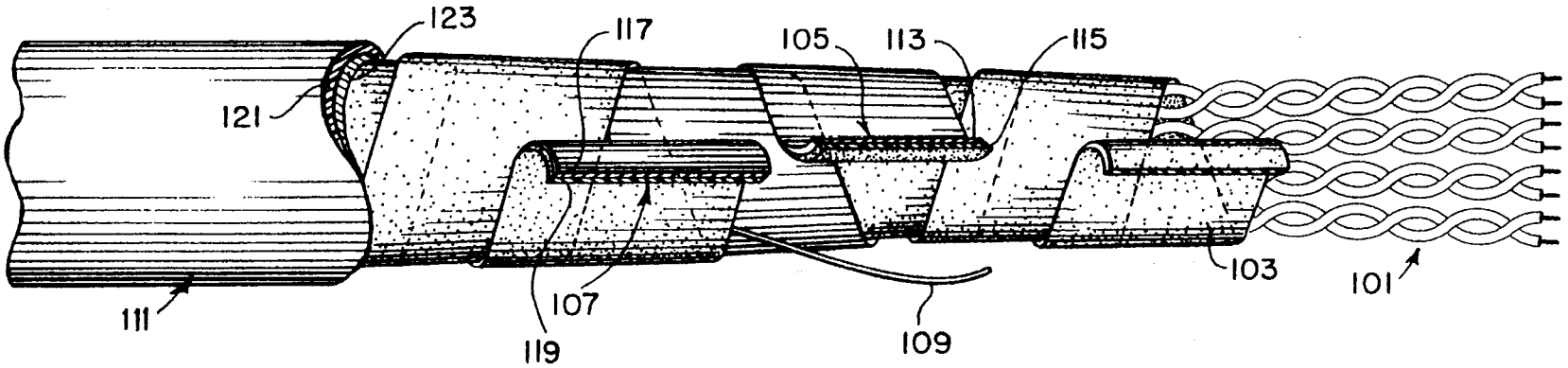
FIG. 2 is a-cut away of a high-speed data cable produced in accordance with the present invention.

The present invention will be better understood in view of the following description, read in connection with the figures.

In brief, the independent twin-foil shielded data cable of the present invention includes two or more insulated conductors forming a cable core 101, an optional inner binder 103, an inner laminated foil tape 105, an outer laminated foil tape 107, a drain wire 109, and a jacket 111. The laminated foil tapes 105 and 107 each include a metal foil side and a non-conductive side. On the inner laminated foil tape 105, the metal foil side 113 is disposed to the outside and the non-conductive side 115 is disposed to the inside. In the case of the outer laminated foil tape 107, the conductive side 117 is disposed to the inside, while the non-conductive side 119 is disposed to the outside.

The example embodiment of the present invention is now described in greater detail.

The cable core 101 may include multiple independent insulated conductors or may include one or more pairs of conductors. In the case of conductor pairs, the insulated conductors may form twisted pairs having left hand or right hand lays having a wide range of periods. The preferred number of pairs to include in the cable core is four. In one preferred embodiment, the conductors have an outside diameter of 0.026 inches, on which an insulating wall of about 0.010 inches has been applied. The insulated wall may be of any suitable material, such as polyethylene or polyvinylchloride.

The inner binder 103 is optional. If it is used, it should be of a non-conductive, material, such as polyester. Typically, the binder 103 would be helically or counter-helically wound about the cable core. The edges of the binder may or may not overlap. Use of the binder 103 helps stabilize the geometry of the cable core 101.

As described above, the inner laminated foil tape 105 includes a conductive side 113 and a non-conductive side 115. The conductive side 113 may be made of any sufficiently conductive material, such as aluminum, copper or conductive polymer. The non-conductive side 115 may be made of such materials as polyester, polypropylene, non-conductive textiles or non-conductive fabrics. One preferred combination is a conductive side 113 of aluminum laminated to a polyester non-conductive side 115. The inner laminated foil tape 105 is applied to the cable core 101 in either a helical or a counter-helical manner. Edges of the laminated foil tape 105 should overlap, although electrical contact between the edges will probably not be made. Also, as indicated above, the conductive side 113 is outwardly disposed, that is away from the cable core 101.

The outer laminated foil tape 107 is similar to the inner laminated foil tape 105, and the non-conductive side 119 is outwardly disposed, except that the conductive side 117 is inwardly disposed, so as to face the conductive side 113 of the inner laminated foil tape 105. It is preferable, but not required, that the directions of winding of the inner and outer laminated foil tapes be opposite.

The drain wire 109 may be of any convenient size. It may be made of solid or stranded wire. Copper or tinned copper may be typically used. In one preferred embodiment, the drain wire is solid tinned copper of the same size as used in the conductors of the cable core 101. The drain wire 109 may be applied helically or longitudinally, but it should be disposed in intimate contact with the conductive sides 113 and 117 of both the inner laminated foil tape 105 and the outer laminated foil tape 107, respectively.

In one preferred embodiment, the inner laminated foil tape 105 is 0.750 inches wide, and the edges overlap by about 25%. The outer laminated foil tape 107 is about 1.000 inches wide, and also has an overlap of approximately 25%. Although the dimensions given tend to produce good shielding characteristics and dielectric spacing characteristics, other suitable dimensions for the components of the described structure will now be understood by those skilled in the art to exist. In particular, although the dimensions of the shield layers may be altered, the structure generally includes two helically applied shield layers, and having overlapping edges.

Finally, the entire cable assembly is covered with a jacket 111. One preferred jacket is simply a thermoplastic co-extrusion, for example made of polyvinylchloride, fluorocarbons, or polyolefins. Alternatively, the cable jacket 111 may comprise a combination of materials including insulating materials 121 and conductive materials 123, so as to provide additional shielding characteristics.

The present invention has now been described in connection with a number of specific embodiments thereof. However, numerous modifications which are contemplated as falling within the scope of the present invention should now be apparent to those skilled in the art. Therefore, it is intended that the scope of the present invention be limited only by the scope of the claims appended hereto.

What is claimed is:

1. An independent twin-foil shielded data cable, comprising:

a cable core of at least one twisted pair of insulated conductors;

an inner shield and an outer shield, each of the inner shield and the outer shield having a conductive layer, and at least one of the inner shield and the outer shield helically wrapped about the cable core so as to have overlapped edges; and a flexible outer jacket;

wherein the inner shield and the outer shield each further comprise a non-conductive layer, and the conductive layer of the inner shield is disposed in continuous contact along the cable with the conductive layer of the outer shield.

2. An independent twin-foil shielded data cable as recited in claim 1, further comprising:

a drain wire disposed between the inner shield and the outer shield, such that contact is made with the conductive layers.

3. An independent twin-foil shielded data cable as recited in claim 1, wherein the non-conductive layer is a polymer.

4. An independent twin-foil shielded data cable as recited in claim 3, wherein the polymer is polyester.

5. An independent twin-foil shielded data cable as recited in claim 3, wherein the polymer is polypropylene.

6. An independent twin-foil shielded data cable as recited in claim 1, wherein the flexible outer jacket further comprises:

a layer of thermoplastic.

7. An independent twin-foil shielded data cable as recited in claim 6, wherein the flexible outer jacket further comprises:

a conductive layer disposed on an interior surface of the jacket.

8. An independent twin-foil shielded data cable as recited in claim 6, wherein the thermoplastic is one of the group polyvinylchloride, fluorocarbon and polyolefin.

9. An independent twin-foil data cable as recited in claim 1, wherein the cable core comprises four twisted pairs of insulated conductors.

10. An independent twin-foil data cable as recited in claim 9, further comprising:

a binder of non-conductive material, helically wrapped about the cable core.

11. An independent twin-foil shielded data cable, comprising:

a cable core of at least one twisted pair of insulated conductors;

an inner shield and an outer shield, each of the inner shield and the outer shield having a conductive layer, and the inner shield and the outer shield each helically wrapped about the cable core so as to have overlapped edges; and a flexible outer jacket;

wherein the inner shield and the outer shield each further comprise a non-conductive layer, and the conductive layer of the inner shield is disposed in continuous contact along the cable with the conductive layer of the outer shield.

12. An independent twin-foil data cable as recited in claim 11, wherein the inner shield and the outer shield are wrapped helically in opposite directions.

13. An independent twin-foil data cable as recited in claim 12, further comprising:

a drain wire disposed between and in contact with the conductive layer of both the inner shield and the outer shield; and the cable core having four twisted pairs of insulated conductors.

* * * * *